US010293393B2

(12) United States Patent
Marx

(10) Patent No.: US 10,293,393 B2
(45) Date of Patent: May 21, 2019

(54) DECK LEVERAGE ANCHOR WITH EXTENSION SWIVEL MOUNTED PULLEY HOLDER

(71) Applicant: Michael J. Marx, Highland, MI (US)

(72) Inventor: Michael J. Marx, Highland, MI (US)

( * ) Notice: Subject to any disclaimer, the term of this patent is extended or adjusted under 35 U.S.C. 154(b) by 737 days.

(21) Appl. No.: 14/990,328

(22) Filed: Jan. 7, 2016

(65) Prior Publication Data

US 2016/0221058 A1 Aug. 4, 2016

Related U.S. Application Data

(60) Provisional application No. 62/101,561, filed on Jan. 9, 2015.

(51) Int. Cl.

| | |
|---|---|
| ***B21J 13/08*** | (2006.01) |
| ***B21D 1/14*** | (2006.01) |
| ***B21D 1/12*** | (2006.01) |

(52) U.S. Cl.

CPC ..... *B21D 1/14* (2013.01); *B21D 1/12* (2013.01); *B21D 1/145* (2013.01)

(58) Field of Classification Search

CPC ..... B21D 1/12; B21D 1/14; B21D 1/145
USPC ..... 72/457, 455
See application file for complete search history.

(56) References Cited

U.S. PATENT DOCUMENTS

| | | | | |
|---|---|---|---|---|
| 4,959,991 | A | 10/1990 | Andersson | |
| 7,343,771 | B2 * | 3/2008 | Marx | B21D 1/12 72/457 |
| 9,162,271 | B2 * | 10/2015 | Marx | B21D 1/12 |
| 2002/0184937 | A1 | 12/2002 | Marx | |
| 2008/0203371 | A1 | 8/2008 | Mauthner | |
| 2012/0086160 | A1 | 4/2012 | Marx | |
| 2012/0087718 | A1 | 4/2012 | Long | |

OTHER PUBLICATIONS

International Search Report and Written Opinion of the ISA for Application No. PCT/US2016/012632, ISA/KR, Daejeon, KR, dated Apr. 29, 2016.

* cited by examiner

*Primary Examiner* — David B Jones
(74) *Attorney, Agent, or Firm* — Harness, Dickey & Pierce, P.L.C.

(57) ABSTRACT

A deck anchor assembly a deck leverage anchor body configured to engage a frame deck and a first coupler yoke configured to couple a second coupler yoke assembly thereto. The second coupler yoke assembly comprises a base portion having second yoke extensions extending therefrom and a swivel post extending from the base portion opposite the second yoke extensions. The swivel post is mounted to the first coupler yoke using a fastener.

15 Claims, 16 Drawing Sheets

DECK LEVERAGE ANCHOR WITH EXTENSION SWIVEL MOUNTED PULLEY HOLDER

CROSS-REFERENCE TO RELATED APPLICATIONS

This application incorporates the description of U.S. application Ser. No. 13/252,614 filed Oct. 4, 2011 by reference which claims the benefit of U.S. Provisional Application No. 61/391,148, filed on Oct. 8, 2010. This application also claims priority to U.S. provisional application No. 62/101,561 filed on Jan. 9, 2015. The entire disclosures of the above applications are incorporated herein by reference.

FIELD

The present disclosure relates generally to frame racks, and more specifically, to an apparatus to couple a hydraulic ram or other equipment to a frame deck.

BACKGROUND

This section provides background information related to the present disclosure which is not necessarily prior art.

Frame racks are typically used to straighten the frame of an automotive vehicle after a collision. A frame rack has a deck onto which the vehicle is placed. A number of towers are positioned around the frame rack. The towers have a chain connected thereto that is coupled to a ram. The chains are connected to the frame of the vehicle and the tower is used to pull the chain toward the tower. Typically, the chains are connected to the vehicle so that the vehicle frame is pulled out in the same direction of impact. When the pulling of the frame begins, it is often necessary to adjust the direction of pulling so the pulling force remains in the direction of impact. Oftentimes, this requires the tension to be released from the vehicle, the tower position to be adjusted, and tension placed on the vehicle frame in a slightly different direction. This, however, is a time consuming process and thus increases the expense of the collision repair.

To place tension on the vehicle in a slightly different direction, a separate hydraulic ram is sometimes coupled to a frame deck. The hydraulic ram may provide push/pull capabilities. Because a tower may not be available, a portable hydraulic ram may be used. The portable hydraulic ram is typically coupled to the frame deck using hooks. One problem with using a hook is that the frame deck is typically formed of a sheet of steel material, commonly 0.5" thick. Although the thickness is substantial, the frame deck may easily be bent when localized pulling on the order of thousands or even tens of thousands of pounds takes place during a straightening operation. If the frame rack is damaged, expensive repairs may be required to be performed. This may result in lost time and thus revenue for the frame rack operator.

It would therefore be desirable to provide a system for allowing flexibility in the frame straightening process and reduce potential damage to frame racks. Also, it is desirable to allow pulling at various angles with respect to the deck.

SUMMARY

This section provides a general summary of the disclosure, and is not a comprehensive disclosure of its full scope or all of its features.

The present disclosure provides a system that facilitates flexibility and maneuverability in anchoring components for performing frame straightening. A deck anchor assembly may be used for anchoring a frame loading member to a frame deck according to the principles of the present disclosure. The deck leverage anchor is configured to engage the frame deck.

The deck anchor assembly includes a deck leverage anchor body configured to engage a frame deck and a first coupler yoke configured to couple a second coupler yoke assembly thereto. The second coupler yoke assembly comprises a base portion having second yoke extensions extending therefrom and a swivel post extending from the base portion opposite the second yoke extensions. The swivel post is mounted to the first coupler yoke using a fastener.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
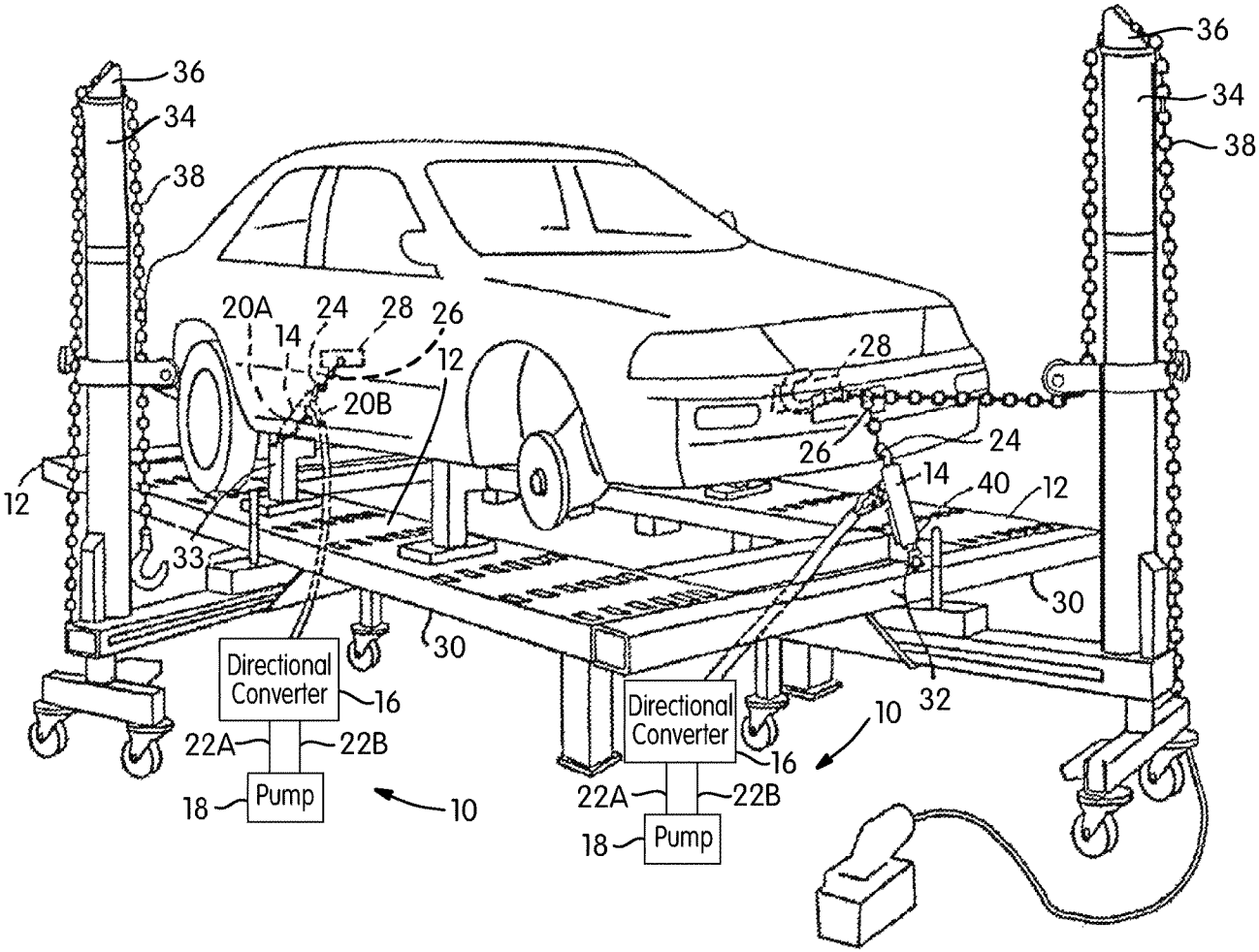
FIG. 1 is an isometric view of a vehicle mounted on a frame deck and hydraulic systems coupled to the vehicle and anchored to the frame deck using a deck leverage anchor according to the present disclosure.

Example embodiments will now be described more fully with reference to the accompanying drawings.

In the following figures, the same reference numerals will be used to identify the same components. The following description is set forth with respect to a frame rack for an automotive vehicle. However, the present application has several uses for mounting a device to a deck. The drawings are to scale, and the geometric relationships (e.g., angles, proportions) between elements shown in the drawings are in accordance with the principles in the present disclosure. However, the drawings are provided for illustrative purposes only and should not be limiting unless set forth in the claims of the present disclosure. Further, the embodiments set forth herein illustrate various alternative features. The various features, however, may be interchanged in the different embodiments. Further, although a two surface deck is used in the following examples, in its simplest form the deck may be a single planar surface.

Referring now to FIG. 1, two hydraulic frame straightening systems 10 according to the present disclosure are illustrated. Hydraulic systems 10 are illustrated used on a frame rack 12. As mentioned above, however, the frame rack 12 is merely illustrative of one of the many applications of the present disclosure. Hydraulic system 10 includes a hydraulic actuator 14, a directional converter 16, and a pump 18. A suitable directional converter is described in U.S. Pat. No. 6,834,526, filed on Jun. 5, 2002, the disclosure of which is incorporated by reference herein.

As illustrated, two hoses 20A and 20B, fluidly couple directional converter 16 and hydraulic actuator 14. Also, two hoses 22A and 22B fluidly couple directional converter 16 and pump 18. Hydraulic actuator 14 may have a mechanical coupling device such as a pair of claw hooks 24. It should be noted that in various applications claw hooks 24 may be substituted with other mechanical fastening devices such as bolt down components, loops, stays, or a deck leverage anchor 40 according to the present disclosure. Claw hook 24 is illustrated mechanically coupled to a chain 26, which in turn is coupled to a portion of a frame 28 of an automotive vehicle.

Frame rack 12 may also include various towers 34 that include a guide 36 and a chain 38. Of course, different numbers of towers 34 may be used on a frame rack. A support 33 may be used to support the vehicle. Frame rack 12 has a deck 30 for positioning a vehicle thereon. Deck 30 may have openings 32 or tie down holes positioned therethrough. Deck leverage anchor 40 may be secured at least partially within one of the openings 32.

Figure 2:
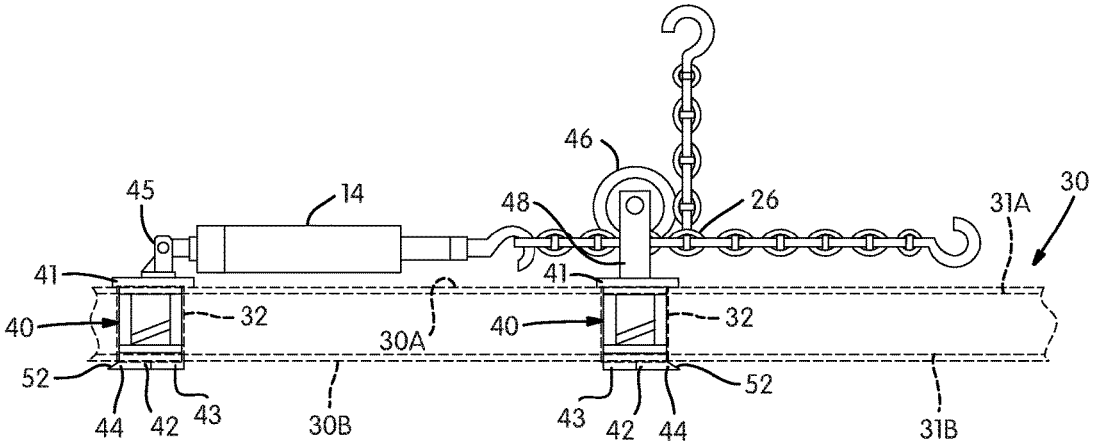
FIG. 2 is a side view of a hydraulic system anchored to a frame deck using a deck leverage anchor according to the present disclosure.

Referring now to FIG. 2, hydraulic actuator 14 is illustrated coupled to deck 30. Deck 30 is shown in phantom to illustrate components that may otherwise be hidden. Deck 30 may have a first surface 30A spaced apart from and/or parallel to a second surface 30B. The first surface 30A may be disposed on an upper plate 31A of deck 30, and the second surface 3AB may be disposed on a lower plate 31B of deck 30. The upper plate 31A and the lower plate 31B may be spaced apart from and/or parallel to each other.

Deck leverage anchor 40 includes an upper plate 41, a lower plate 42, and a swivel plate 43 that swivels with respect to the lower plate 42. The upper plate 41 and the lower plate 42 may be vertically spaced apart and connected to each other using spacers or risers, as discussed below.

Deck leverage anchor 40 may be inserted into the opening 32 such that the upper plate 41 engages or rests on the first surface 30A and a flange 44 on the lower plate 42 engages the second surface 30B. The upper plate 41 and the lower plate 42 of deck leverage anchor 40 may be parallel to the upper plate 31A and the lower plate 32A of deck 30. The profile of the lower plate 42 may be sized to fit within the opening 32 to allow insertion of deck leverage anchor 40 into the opening. As discussed below, the swivel plate 43 may then be rotated from an unlocked position to a lock position such that the swivel plate 43 engages the second surface 30B. In the lock position, opposite ends of deck leverage anchor 40 engage the second surface 30B. As a result, deck leverage anchor 40 is locked in place relative to deck 30. In this regard, the swivel plate 43 and components used to rotate and/or retain the swivel plate 43 may be collectively referred to as a locking mechanism. The components used to rotate the swivel plate 43 may include a lever disposed above deck 30 and components that couple the lever to the swivel plate 43 such that the locking mechanism is accessible in an area other than under deck 30.

Hydraulic actuator 14 is coupled to deck 30 using an actuator coupler 45. Actuator coupler 45 couples hydraulic actuator 14 to deck leverage anchor 40. As discussed in more detail below, actuator coupler 45 may be rotated with respect to deck leverage anchor 40 and independent from the swivel plate 43.

A pulley 46 may also be coupled to deck 30. Pulley 46 may be coupled to deck 30 using a pulley coupler 48. Pulley coupler 48 couples pulley 46 to deck leverage anchor 40. As discussed in more detail below, pulley coupler 48 may be rotated with respect to deck leverage anchor 40 and independent from the swivel plate 43. The hydraulic actuator 14 and the pulley 46 may be referred to as frame loading members, as the hydraulic actuator 14 and the pulley 46 are used to apply a load on a vehicle frame.

Figure 3:
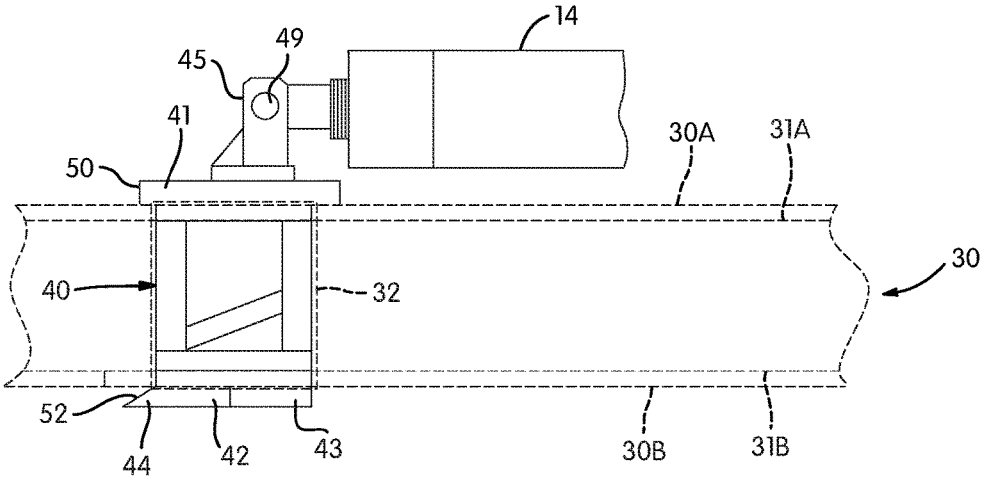
FIG. 3 is a side view of a hydraulic actuator anchored to a frame deck using a deck leverage anchor according to the present disclosure.

Referring now to FIG. 3, actuator coupler 45 and deck leverage anchor 40 are illustrated in further detail relative to deck 30. Deck 30 is shown in phantom to illustrate components that may otherwise be hidden. Actuator coupler 45 is coupled to hydraulic actuator 14 using a pin or fastener 49. The size of the upper plate 41 is such that the upper plate 41 remains above the first surface 30A while a portion of deck leverage anchor 40 extends below the first surface 30A. For example, the perimeter of the upper plate 41 may be larger than the perimeter of the opening 32. The upper plate 41 includes a flange 50 that engages the portion of the first surface 30A surrounding the opening 32.

The flange 44 of the lower plate 42 includes a ramped surface 52. The ramped surface 52 of the flange 44 inhibits contact between the flange 44 and the deck 30 when the flange 44 is positioned below the second surface 30B. This facilitates insertion of deck leverage anchor 40 into the opening 32.

Figure 4:
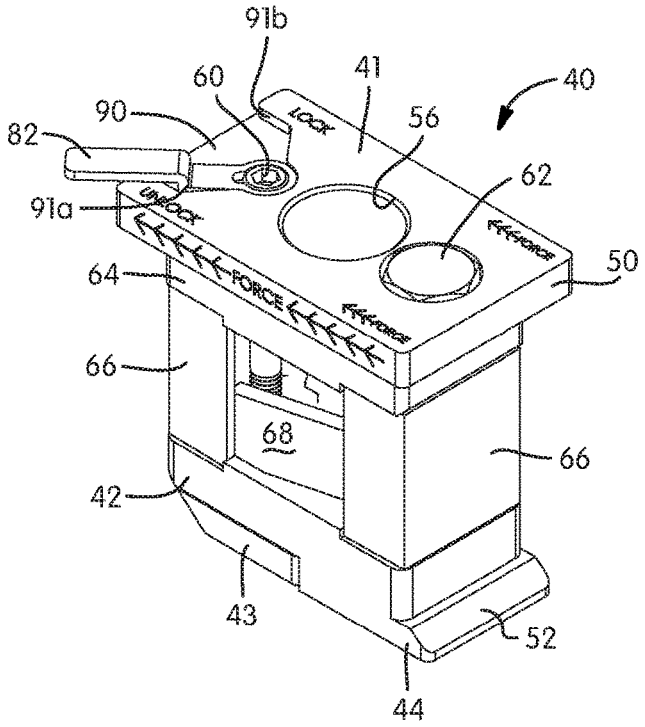
FIG. 4 is an isometric view of a deck leverage anchor according to the present disclosure, the deck leverage anchor including a locking mechanism in an unlocked position.
Figure 5:
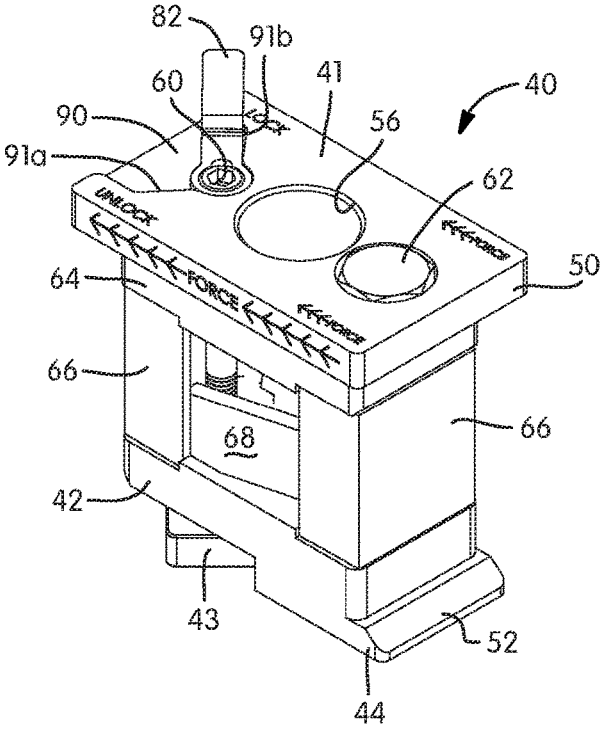
FIG. 5 is an isometric view of the deck leverage anchor of FIG. 4 with the locking mechanism in a locked position.
Figure 6:
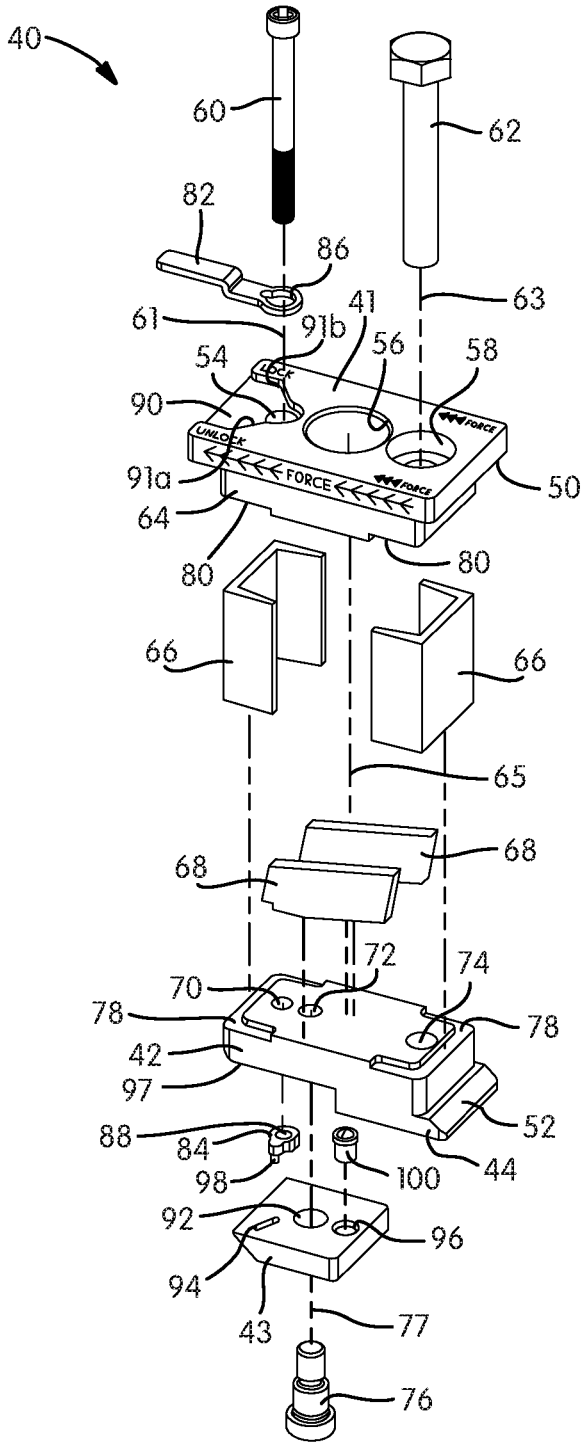
FIG. 6 is an exploded isometric view of the deck leverage anchor of FIG. 4.

Referring now to FIGS. 4 through 8, deck leverage anchor 40 is illustrated in greater detail. The upper plate 41 defines a first hole 54, a second hole 56, a third hole 58, as best shown in FIG. 6. The first hole 54 receives an extension pin or bolt 60. The center of the bolt 60 may be parallel to and/or aligned with an axis 61 that extends through the center of the first hole 54. The second hole 56 is configured to receive a coupler such as the actuator coupler 45 or the pulley coupler 48. The third hole 58 receives a mounting bolt 62. The center of the bolt 62 may be parallel to and/or aligned with an axis 63 that extends through the center of the third hole 58. The third hole 58 is counterbored to accommodate the head of the bolt 62 to prevent contact between the coupler and the head of the bolt 62 when the coupler is rotated about the second hole 56. The center of the coupler may be parallel to and/or aligned with an axis 65 that extends through the center of the second hole 56. The coupler may swivel on an axis (e.g., axis 65) that is parallel to and/or aligned with its insertion direction, as discussed below with reference to FIG. 15.

A base 64 may be formed (e.g., machined) integrally with the upper plate 41. Alternatively, the base 64 and the upper plate 41 may be formed separately and attached together. The flange 50 on the upper plate 41 is the portion of the upper plate 41 that extends beyond the perimeter of the base 64. The base 64 may be sized to fit within and engage the opening 32 in the deck 30.

Risers 66 couple and space apart the upper plate 41 and the lower plate 42. The risers 66 may be c-channels, as shown, and may be spaced apart and/or parallel to one another. In addition, the risers 66 may be parallel to the axis 63 and/or the insertion direction of the bolts 60 and/or the bolt 62. The heights of the risers 66 may be selected to ensure that the swivel plate 43 may be rotated into engagement with the second surface 30B when the upper plate 41 is resting on the first surface 30A, as discussed above. The longitudinal ends of the risers 66 are attached (e.g., welded) to the base 64 and the lower plate 42.

Cross members or gussets 68 extend between the risers 66. The gussets 68 may increase the stiffness and/or strength of deck leverage anchor 40. The gussets 68 may have a generally parallelogram shape. The longitudinal ends of the gussets 68 are attached (e.g., welded) to the risers 66.

The lower plate 42 defines a first hole 70, a second hole 72, and a third hole 74, as best shown in FIG. 6. The first hole 70 receives the bolt 60. The second hole 72 receives a fastener 76, such as a shield screw, that couples the swivel plate 43 to the lower plate 42. The center of the fastener 76 may be parallel to and/or aligned with an axis 77 that extends through the center of the first hole 70. The swivel plate 43 may rotate on the axis 77. The third hole 74 receives the bolt 62. The bolt 62 may be threaded into the third hole 74. The axes 61, 63, 65, and/or 77 may be parallel to and/or offset from one another.

The lower plate 42 also defines recessed surfaces 78 and the base 64 defines recessed surfaces 80, as best shown in FIG. 6. The recessed surfaces 78, 80 may be configured to receive the longitudinal ends of the risers 66. This facilitates attaching the risers 66 to the base 64 and the lower plate 42.

The bolt 60 extends through the first hole 54 in the upper plate 41 and through the first hole 70 in the lower plate 42. The bolt 60 couples a lever 82 to a cam 84 and the cam 84 engages the swivel plate 43 such that the swivel plate 43 rotates with the lever 82 between the unlocked position and the locked position, as described in more detail below. The bolt 60 extends through a hole 86 in the lever 82. The lever 82 and the cam 84 are attached to the bolt 60. For example, the lever 82 may be welded to the bolt 60, and the bolt 60 may be threaded into a hole 88 in the cam 84. A portion of the lever 82 may be captured between the head of the bolt 60 and a recessed surface 90 in the upper plate 41. At least a portion of the lever 82 may rotate within a plane that is parallel to the recessed surface 90 in the upper plate 41 and the surfaces 30A, 30B on deck 30. In addition, the lever 82 may rotate within a plane that is perpendicular to the axis 61, the axis 63, the axis 65, the risers 66 and/or the axis 77.

The lower plate 42 further defines a first surface 91*a* and a second surface 91*b*. The first surface 91*a* engages the lever 82 when the lever 82 is in the unlocked position, as best shown in FIG. 4. The second surface 91*b* engages the lever 82 when the lever 82 is in the locked position, as best shown in FIG. 5.

The bolt 62 extends through the third hole 58 in the upper plate 41 and extends at least partially through the third hole 74 in the lower plate 42. The bolt 62 couples the upper plate 41 and the lower plate 42. The bolt 62 may be used to couple the upper plate 41 and the lower plate 42 before the risers 66 are attached to the base 64 and the lower plate 42. In addition, the bolt 62 may be used to increase the strength of the connection between the upper plate 41 and the lower plate 42.

The swivel plate 43 defines a first hole 92, a channel 94, and a second hole 96, as best shown in FIG. 6. The fastener 76 may extend through the first hole 92 in the swivel plate 43 and thread into the second hole 72 in the lower plate 42. Thus, the swivel plate 43 may be captured between the head of the fastener 76 and a recessed surface 97 in the lower plate 42. The channel 94 receives a pin 98 on the cam 84. The second hole 96 receives a ball plunger 100. The ball plunger 100 is configured to lock the swivel plate 43 relative to the lower plate 42. The ball plunger 100 may be press fit into the second hole 96.

Figure 7:
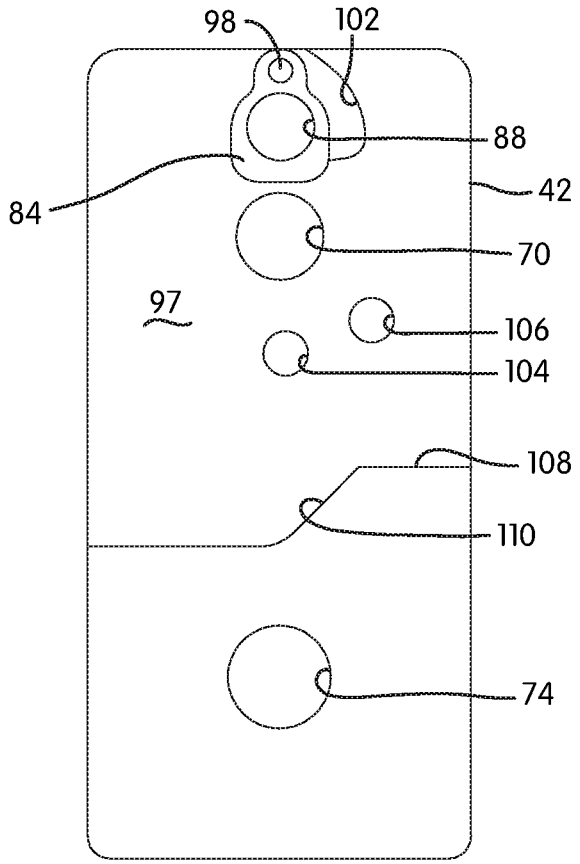
FIG. 7 is a bottom view of the deck leverage anchor of FIG. 4 with a portion of the locking mechanism removed.

The lower plate 42 further defines a groove 102, an unlock detent 104, a lock detent 106, a first surface 108, and a second surface 110, as best shown in FIG. 7. The groove 102 accommodates the cam 84 as the cam 84 rotates. The unlock detent 104 receives the ball plunger 100 and the first surface 108 engages the swivel plate 43 when the swivel plate 43 is in the unlocked position. The lock detent 106 receives the ball plunger 100 and the second surface 110 engages the swivel plate 43 when the swivel plate 43 is in the locked position.

Figure 8:
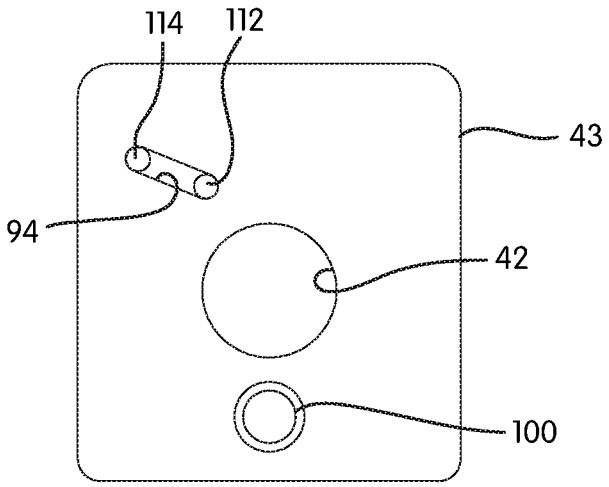
FIG. 8 is a top view of the portion of the locking mechanism removed from FIG. 7.

The channel 94 in the swivel plate 43 may define an unlock detent 112 and a lock detent 114, as best shown in FIG. 8. The unlock detent 112 receives the pin 98 on the cam 84 when the swivel plate 43 is in the unlocked position. The lock detent 114 receives the pin 98 on the cam 84 when the swivel plate 43 is in the locked position.

Figure 9:
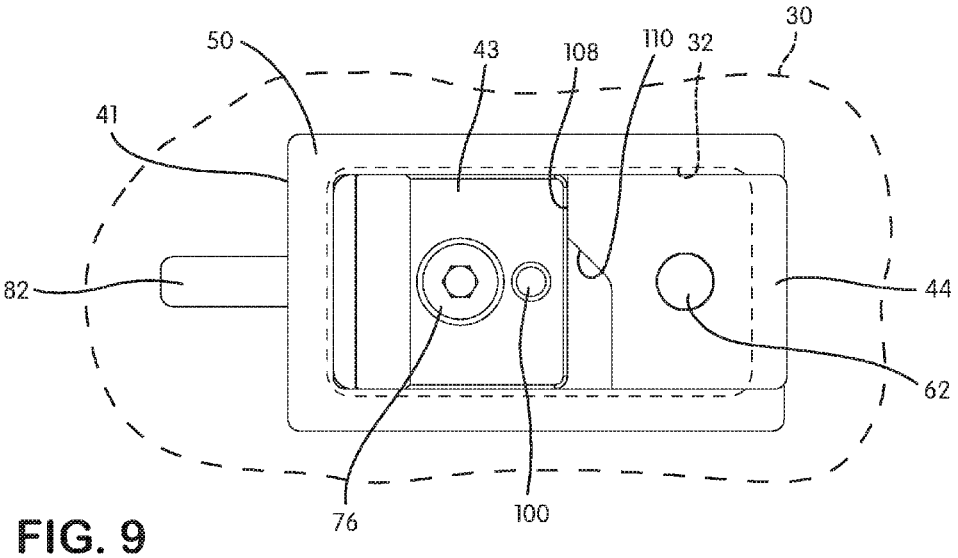
FIG. 9 is a bottom view of the deck leverage anchor of FIG. 4 disposed in an opening in a frame deck, with the locking mechanism in the unlocked position.

With continued reference to FIGS. 4 through 8, and additional reference to FIGS. 9 through 12, operation of deck leverage anchor 40 will now be described in detail. Deck leverage anchor 40 may be inserted into the opening 32 within deck 30 when the lever 82 is in the unlocked position. When the lever 82 is in the unlocked position, the profile of the swivel plate 43 is aligned with the profile of the lower plate 42, as best shown in FIG. 9. Thus, deck leverage anchor 40 may be inserted into the opening 32 in deck 30 without interference between the swivel plate 43 and deck 30.

Figure 11:
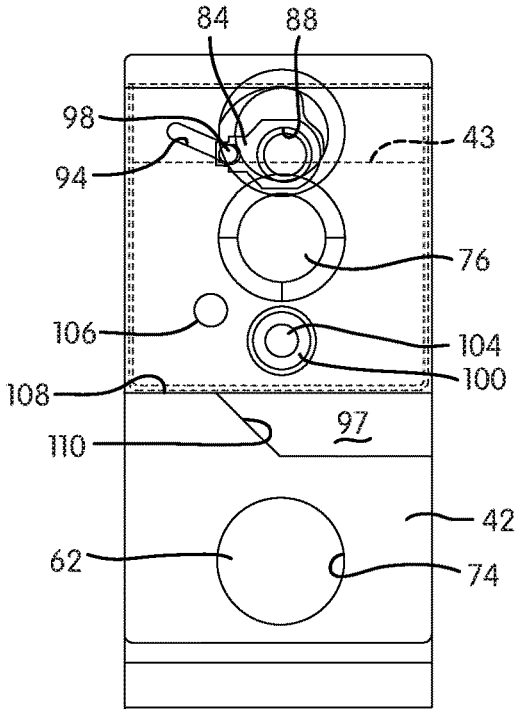
FIG. 11 is a bottom view of the deck leverage anchor of FIG. 4 with the locking mechanism in the unlocked position and a portion of the locking mechanism shown in phantom.

In addition, in the unlocked position, the ball plunger 100 engages the unlock detent 104 in the lower plate 42, as best shown in FIG. 11. Since the ball plunger 100 is inserted through the hole 96 in the swivel plate 43, the engagement between the ball plunger 100 and the unlock detent 104 retains the swivel plate 43 in the unlocked position. Further, in the unlocked position, the unlock detent 112 in the channel 94 of the swivel plate 43 (shown in FIG. 8) engages the pin 98 on the cam 84. Since the cam 84 is coupled to the lever 84 via the bolt 60, the engagement between the unlock detent 112 and the pin 98 retains the lever 84 in the unlocked position.

Deck leverage anchor 40 is inserted into the opening 32 in deck 30 as discussed above with reference to FIG. 2. The lever 82 may then be rotated from the unlocked position to the locked position. In turn, the lever 82 rotates the bolt 60, the bolt 60 rotates the cam 84, and the pin 98 on the cam 84 engages and moves along the channel 94 in the swivel plate 43. This causes the swivel plate 43 to rotate and disengages the ball plunger 100 from the unlock detent 104 in the lower plate 42. The lever 82 rotates about the center of the bolt 60 and the swivel plate 43 rotates about the center of the fastener 76. Thus, the rotational axes of the swivel plate 43 and the lever 82 are offset from each other.

Figure 10:
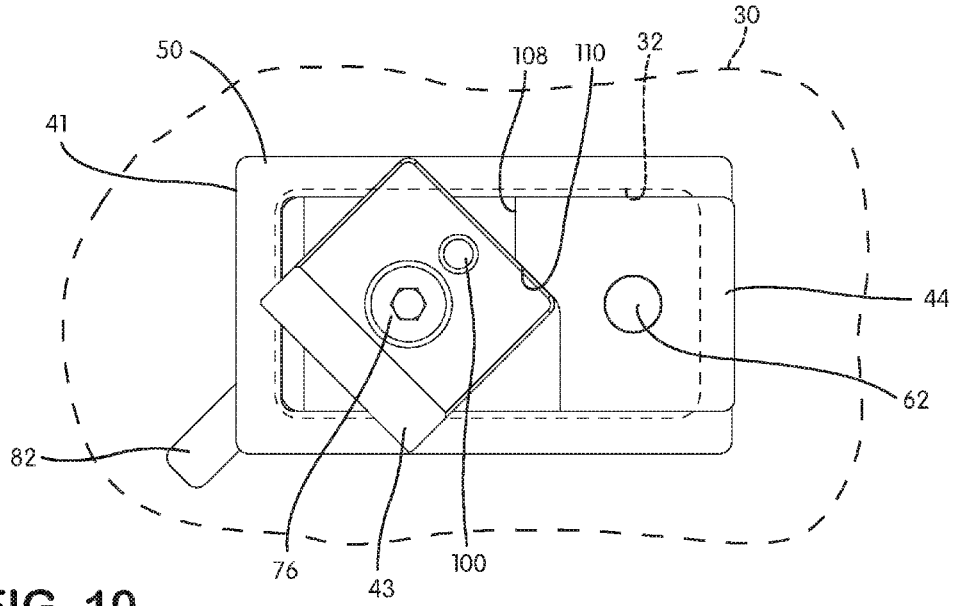
FIG. 10 is a bottom view of the deck leverage anchor of FIG. 4 disposed within an opening in a frame deck, with the locking mechanism in the locked position.

In the locked position, the perimeter of the swivel plate 43 extends beyond the perimeter of the opening 32 in deck 30, as best shown in FIG. 10. Thus, the flange 44 on the lower plate 42 and the swivel plate 43 engage portions of deck 30 adjacent to opposite ends of the opening 32. This engagement prevents removal of deck leverage anchor 40 from the opening 32.

Figure 12:
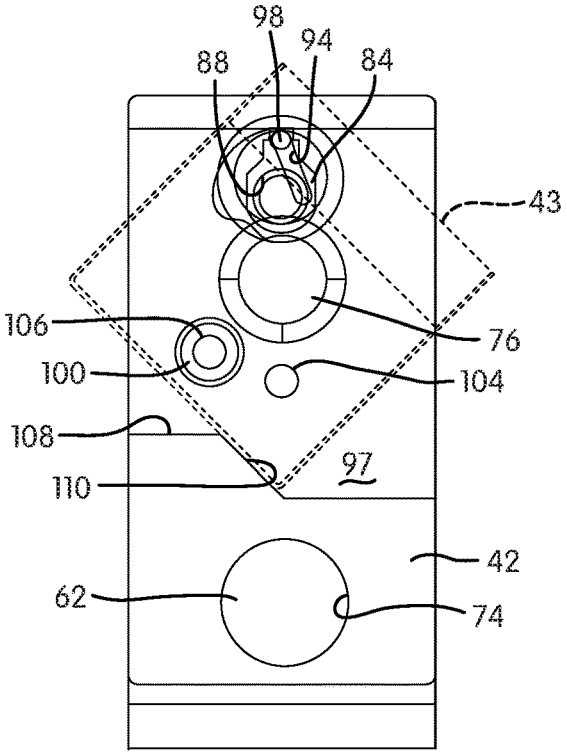
FIG. 12 is a bottom view of the deck leverage anchor of FIG. 4 with the locking mechanism in the locked position and a portion of the locking mechanism shown in phantom.

In addition, in the locked position, the ball plunger 100 engages the lock detent 106 in the lower plate 42, as best shown in FIG. 12. Since the ball plunger 100 is inserted through the hole 96 in the swivel plate 43, the engagement between the ball plunger 100 and the lock detent 106 retains the swivel plate 43 in the locked position. Further, in the locked position, the lock detent 114 in the channel 94 of the swivel plate 43 (shown in FIG. 8) engages the pin 98 on the cam 84. Since the cam 84 is coupled to the lever 82 via the bolt 60, the engagement between the lock detent 114 and the pin 98 retains the lever 82 in the locked position.

To remove deck leverage anchor 40 from the opening 32 in deck 30, the lever 82 may be rotated from the locked position to the unlocked position. The first surface 91*a* of the upper plate 41 may act as a stop for the lever 82 and the first surface 108 may act as a stop for the swivel plate 43 as the lever 82 is rotated to the unlocked position. The second surface 91*b* of the upper plate 41 may act as a stop for the lever 82 and the second surface 110 may act as a stop for the swivel plate 43 as the lever 82 is rotated to the locked position.

Figure 13:
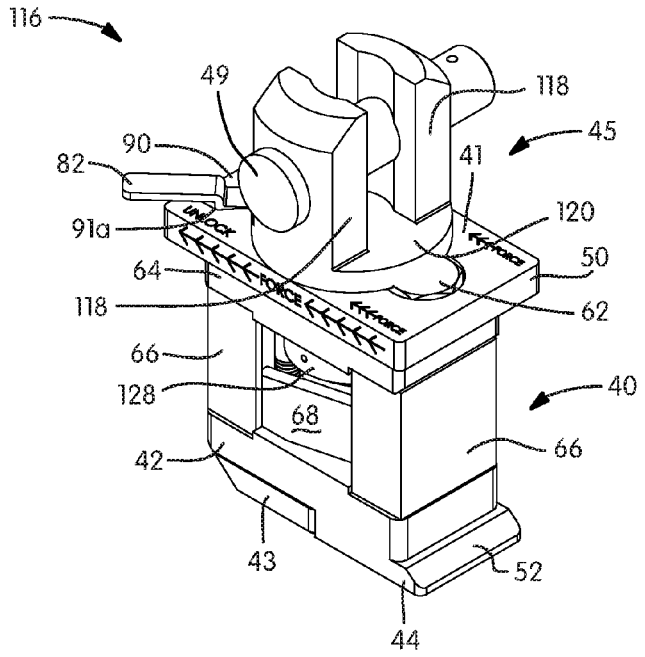
FIG. 13 is an isometric view of a deck anchor assembly including the deck leverage anchor of FIG. 4 and an actuator coupler, with the locking mechanism in the unlocked position.
Figure 14:
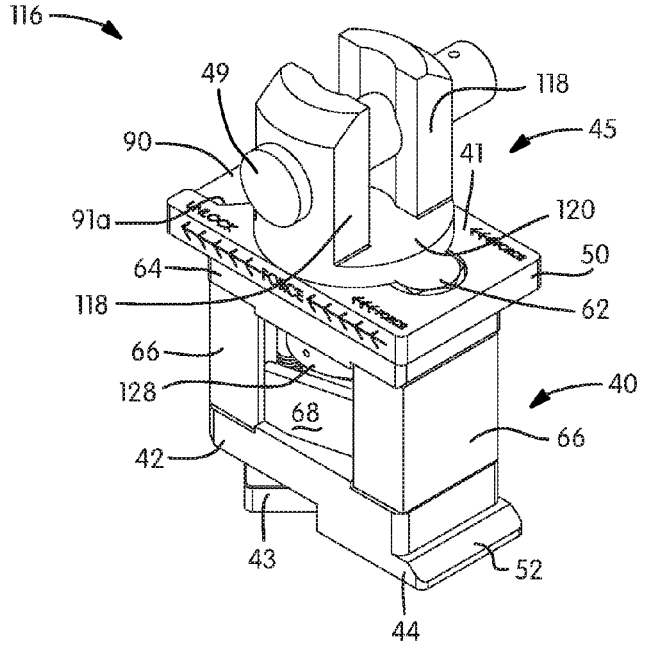
FIG. 14 is an isometric view of the deck anchor assembly of FIG. 13 with the locking mechanism in the locked position.
Figure 15:
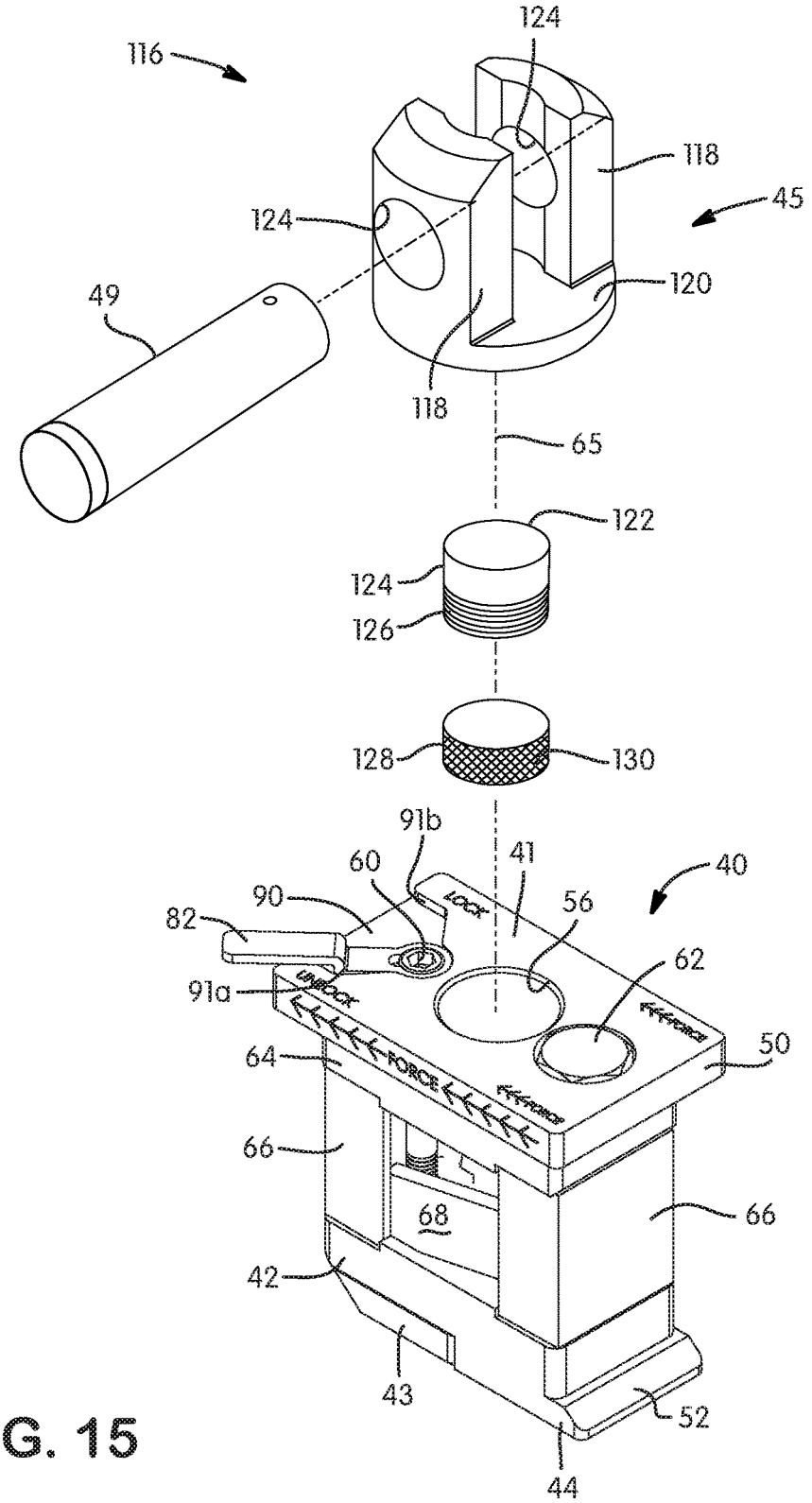
FIG. 15 is an isometric view of the deck anchor assembly of FIG. 4 and an exploded isometric view of the actuator coupler of FIG. 13.

Referring now to FIGS. 13 through 15, a deck anchor assembly 116 that includes deck leverage anchor 40 and the actuator coupler 45 is illustrated. The actuator coupler 45 includes extensions 118 extending from one side of a base 120 and a shaft 122 extending from the opposite side of the base 120, as best shown in FIG. 15. The extensions 118, the base 120, and/or the shaft 122 may be integrally formed. Alternatively, the extensions 118, the base 120, and/or the shaft 122 may be formed separately and attached to one another. The center of the base 120 and the center of the shaft 122 may be parallel to and/or aligned with the axis 65 that extends through the center of the second hole 56. In addition, the actuator coupler 45 may rotate about the axis 65.

The extensions 118 define holes 124 configured to receive the fastener 49, as best shown in FIG. 15. The extensions 118 are spaced apart such that the hydraulic actuator 49 may be inserted between the extensions 118. The fastener 49 may then be inserted through the holes 120 in the extensions 118 and through the hydraulic actuator 49 to secure the hydraulic actuator 49 to the actuator coupler 45. The base 120 may engage the top surface of the upper plate 41 as the actuator coupler 45 is rotated relative to deck leverage anchor 40. The bolts 60, 62 and the lever 82 may be recessed to avoid contact with the base 120 as the actuator coupler 45 is rotated relative to deck leverage anchor 40.

The shaft 122 extends through the second hole 56 in the upper plate 41 and the actuator coupler 45 freely rotates about the shaft 122 without restriction. The shaft 122 may include a bearing portion 124 and a threaded portion 126, as best shown in FIG. 15. The bearing portion 124 may engage the upper plate 41 as the actuator coupler 45 is rotated relative to deck leverage anchor 40. The threaded portion 126 may extend beyond the upper plate 41, and a collar 128 having inner threads 130 may be threaded onto the threaded portion 126 to secure the actuator coupler 45 to deck leverage anchor 40.

With continue reference to FIGS. 13 through 15, operation of the deck anchor assembly 116 will now be described. Deck leverage anchor 40 may be inserted into the opening 32 in deck 30 in the manner described above. In turn, the lever 82 may then be rotated from the unlocked position (FIG. 13) to the locked position (FIG. 14) to rotate the swivel plate 43 and thereby lock deck leverage anchor 40 in place relative to deck 30.

Notably, rotating the swivel plate 43 does not rotate the actuator coupler 45, as the actuator coupler 45 and the swivel plate 43 rotate independently. Thus, the actuator coupler 45 may be repositioned (e.g., rotated) without unlocking deck leverage anchor 40 from deck 30. This saves time and thus increases revenue for the frame rack operator. In addition, the lever 82 rotates about the center of the bolt 60, the swivel plate 43 rotates about the center of the fastener 76, and the actuator coupler 45 rotates about the center of the shaft 122. Thus, the rotational axes of the swivel plate 43, the actuator coupler 45, and the lever 82 are offset relative to one another.

Figure 16:
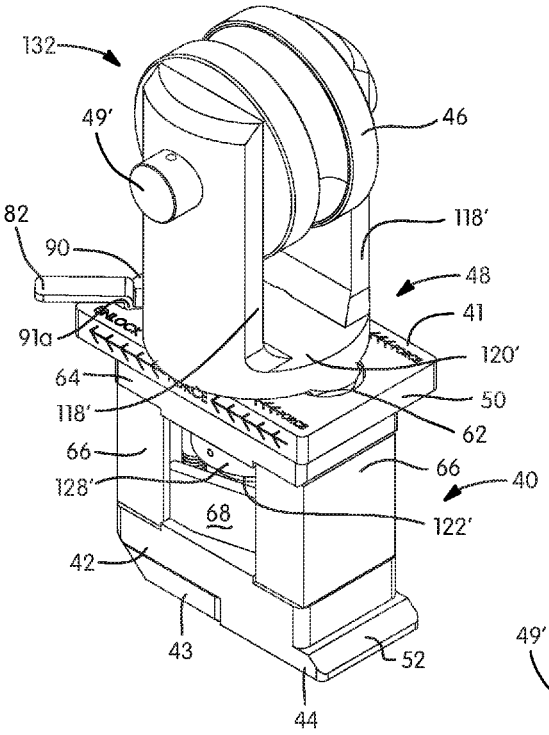
FIG. 16 is an isometric view of a deck anchor assembly including the deck leverage anchor of FIG. 4 and a pulley coupler, with the locking mechanism in the unlocked position.
Figure 17:
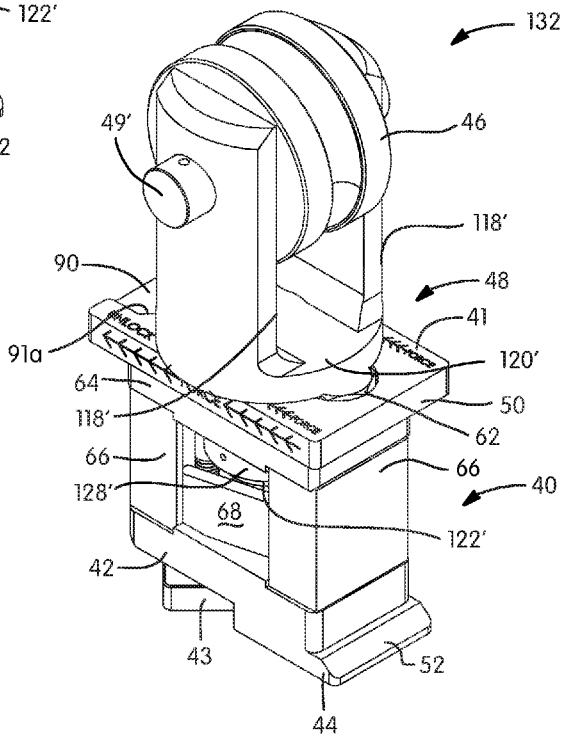
FIG. 17 is an isometric view of the deck anchor assembly of FIG. 16 with the locking mechanism in the locked position.

Referring now to FIGS. 16 and 17, a deck anchor assembly 132 that includes deck leverage anchor 40 and the pulley coupler 48 is illustrated. The structure of the deck anchor assembly 132 may be substantially similar to the structure of the deck anchor assembly 116 such that only differences between the two structures will now be described.

The pulley coupler 48 includes extensions 118'. The heights of the extensions 118' on the pulley coupler 48 may be greater than the heights of the extensions 118 on the actuator coupler 45 to accommodate the outer diameter of the pulley 46 and/or a chain engaging the pulley 46. In addition, the space between the extensions 118' on the pulley coupler 48 may be respectively greater than the heights of the extensions 118 and the space between the extensions 118 to accommodate the width of the pulley 46.

Operation of the deck anchor assembly 132 may be substantially similar to or identical to operation of the deck anchor assembly 116.

Referring now to FIGS. 18-26, improvements that provide a measure of safety as well as improves the clearances of the embodiments set forth in FIGS. 1-17 is provided herein. The changes made to the deck leverage anchor in FIGS. 18-26 were made due to the frame machine companies making new machine towers that roll all the way around the machines exterior.

The clearance between the bottom of the deck and the top of the roller cage on the tower is approximately a quarter inch. Therefore, the bottom palate 42 shown in FIGS. 1-17 protrudes too far through the bottom of the deck and forces the tower (34 of FIG. 1) into an offset hook up. The technician would have to build the tower before positioning the pulley. The anchor base of FIGS. 18-26 allows the tower roller carriage to pass under the underside of the lower plate 42, swivel plate 43 and flange 44. The updated configuration allows the technician to have the leverage anchor installed while in line with the tower and complete the pull without a bolt or other protrusion impacting the position of the tower.

The pulley of the deck leverage anchor in FIGS. 1-17 was limited to a load zone that was anywhere from 50 degrees to 90 degrees off the pulley. The technician would have to set up within the limited load zone. Also the up direction for the pulley and coupler on the anchor base was predictable as long as a technician configured it properly. The pulley holder of the leverage anchor illustrated in FIGS. 18-25 was created to eliminate the up force and allows the pulley to use forward pressure by placing the pulley wheel in front of the coupler (the pulley is toward the direction of the force of the pull). It not only works off of forward pressure but the load zone increases greatly. This also reduces the possibility of a technician hooking the pulley up wrong and therefore making the deck leverage anchor safer.

Figure 18:
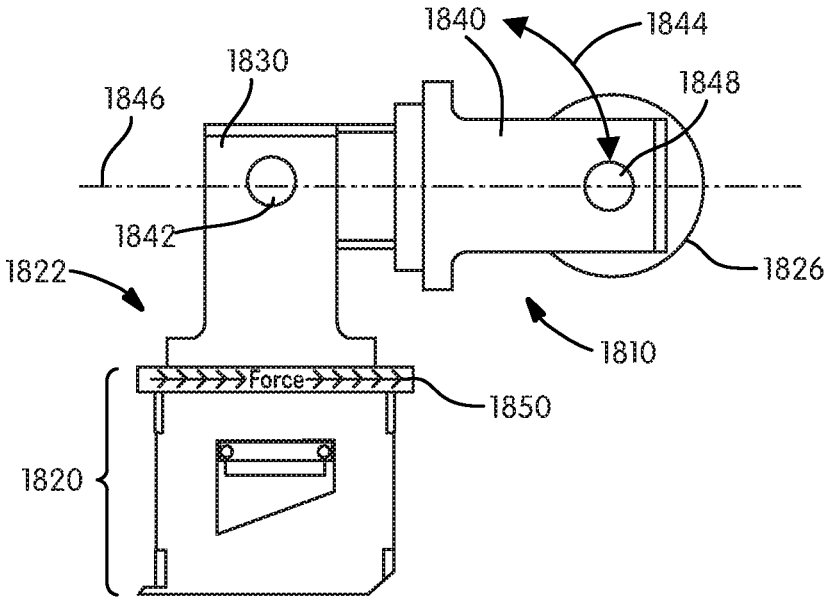
FIG. 18 is a side view of a deck anchor assembly.

In FIG. 18, the yoke assembly 1810 is rotatably coupled to the leverage anchor body 1820 and forms a deck leverage anchor 1822. The leverage anchor body 1820 may be assembled in a manner consistent to that set forth above. However, the leverage anchor body 1820 may not have a swivel plate. The leverage anchor assembly 1822 may include a pulley 1826 that is rotatably mounted to the yoke assembly 1810. Of course, other devices such as a hydraulic assembly may also be mounted thereto.

In general, the yoke assembly 1810 includes a first coupler yoke 1830 and a second coupler yoke 1840. The first coupler yoke 1830 is rotatably coupled to the leverage anchor body 1820. The first coupler yoke 1830 will be described in more detail below.

The second coupler yoke 1840 is coupled to the first coupler yoke 1830 using a fastener, such as a pin 1842. The pin 1842 allows the second coupler yoke 1840 to travel in the direction illustrated by the arrow 1844. The second coupler yoke 1840 may also be rotatably coupled to the first coupler yoke 1830 and may rotate around the axis 1846. A second pin 1848 is used to couple the pulley 1826 to the second coupler yoke 1840. The second coupler yoke 1840 will be described in further detail below. It should be noted that the pulley 1826 is mounted forward of the leverage anchor body in the direction of force illustrated by the arrow 1850.

Figure 19A:
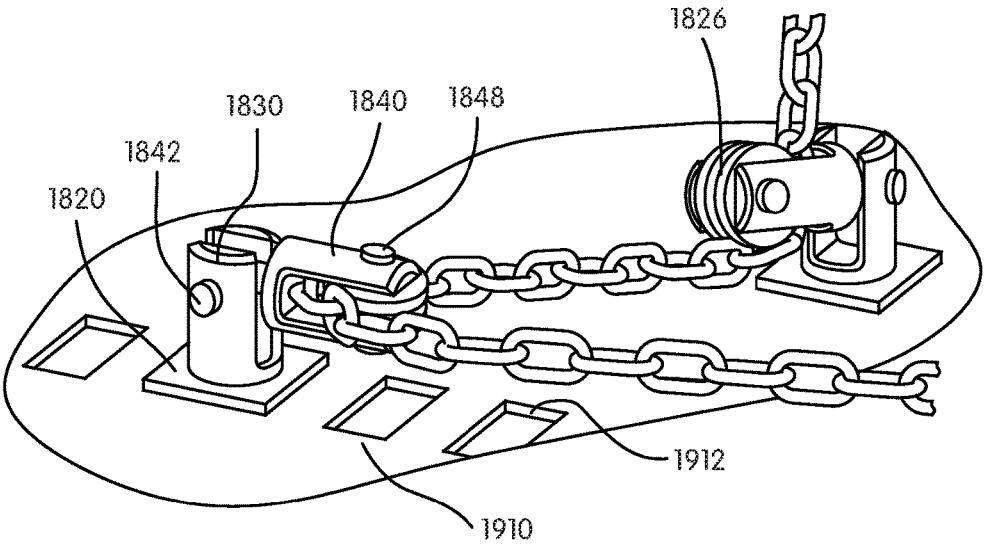
FIG. 19A is a perspective view of two deck anchor assemblies fastened to a frame rack deck with a pulling chain therein.

Referring now to FIG. 19A, a mounting surface 1910 of a frame rack is illustrated. The frame rack has rectangular openings 1912, in this example. The deck leverage anchor body 1822 is mounted therein. In this example, two deck leverage assemblies 1810 are illustrated. A chain 1914 extends between a hydraulic component and a frame of a vehicle as was described with respect to FIG. 1.

Figure 19B:
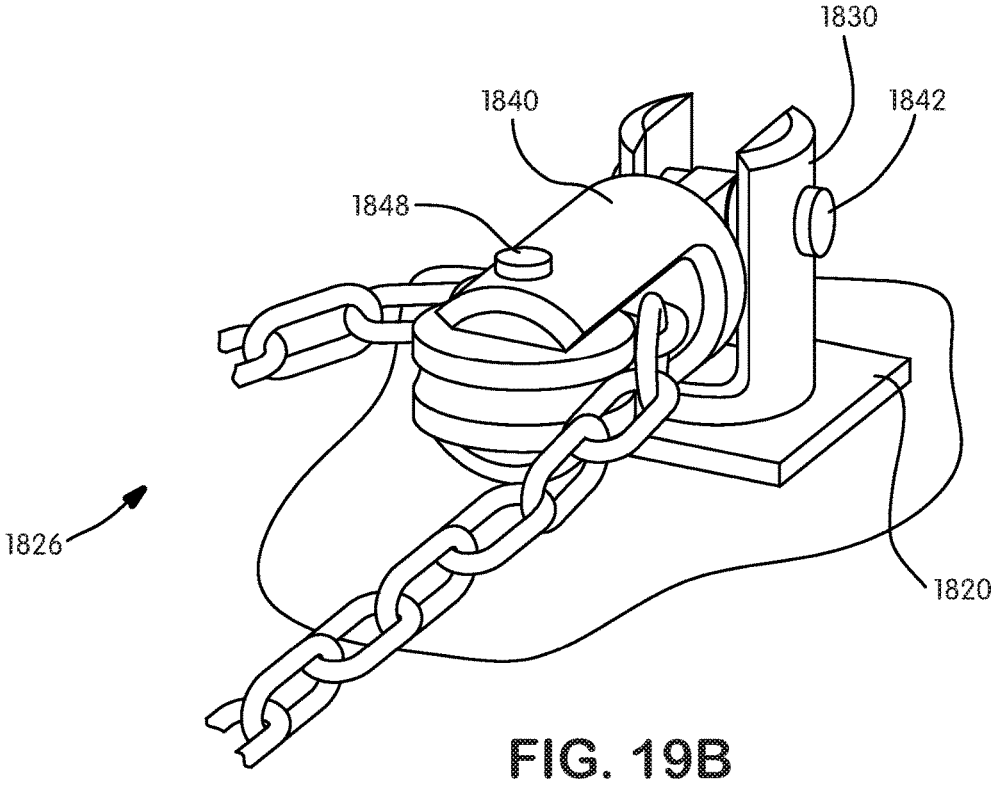
FIG. 19B is a perspective view of a leverage anchor assembly.

Referring now to FIG. 19B, another view of the deck leverage anchor assembly 1822 is set forth. In this example, the end view illustrating the coupling of the pulley 1826 to the second coupler yoke is set forth.

Figure 20A:
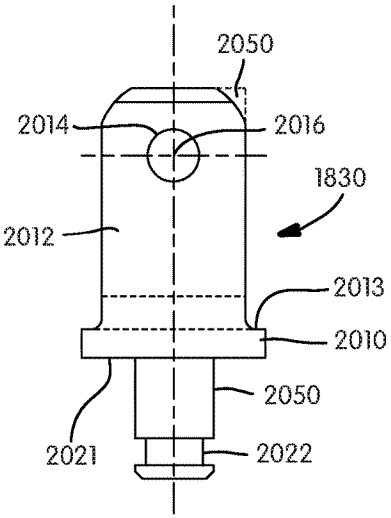
FIG. 20A is a side view of a first coupler yoke.
Figure 20C:
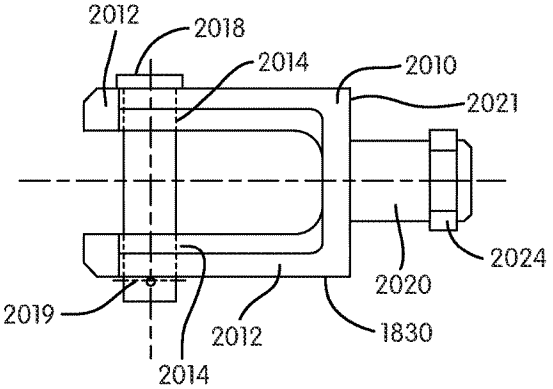
FIG. 20C is a second side view of the first coupler yoke.
Figure 20D:
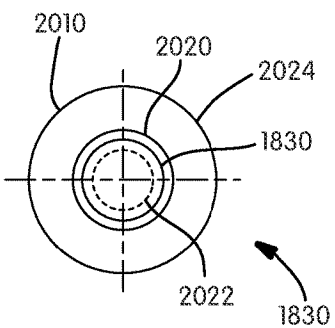
FIG. 20D is a bottom view of the first coupler yoke.
Figure 20B:
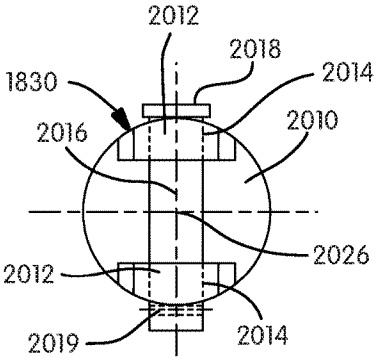
FIG. 20B is a top view of a first coupler yoke.

Referring now to FIGS. 20A-20D, the first coupler yoke 1830 is illustrated in further detail. FIG. 20A is a side view of the coupler yoke 1830, FIG. 20B is a top view, FIG. 20C is a front view, and FIG. 20D is a bottom view of the first coupler yoke 1830.

The first coupler yoke 1830 includes a first base 2010 that has a pair of first yoke extensions 2012 extending therefrom. Both of the first yoke extensions 2012 extend from a first side 2013 of the base 2010. Each of the yoke extensions 2012 includes an opening 2014. The openings 2014 are axially aligned about the axis 2016. This allows a pin 2018 to extend through each of the openings 2014 of the first yoke extensions 2012. The pin 2018 may have a channel 1019 there through for receiving a retainer (not shown) for keeping the pin 2020 within the opening 2014.

A swivel post 2020 extends from a second side 2021 of the first base 2010. The swivel post 2020 includes a 2022 therearound. The groove 2022 may receive a collar 2024.

The first coupler yoke 1830 is generally U-shaped, having the extensions 2012 extending from the first base 2010. The swivel post 2020 rotates freely about central point 2026 when coupled to the deck leverage anchor body 1820 (of FIG. 18).

A portion of the material of the extensions 2012 may be removed in the area 2050. The amount of material removed in the area 2050 may be used to control the amount of rotation of the second coupler assembly 1840 (of FIG. 18) relative to the first coupler yoke 1830.

Figure 21A:
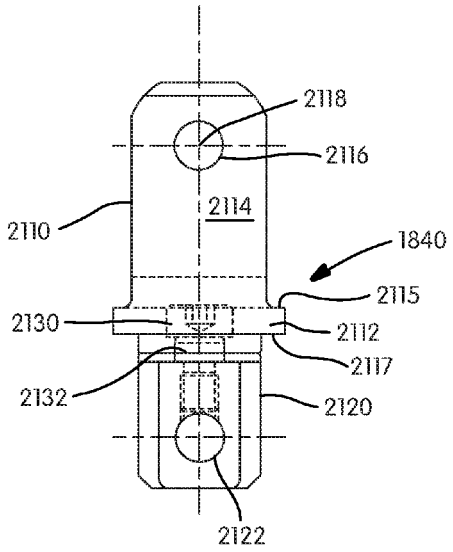
FIG. 21A is a side view of the second coupler yoke assembly.
Figure 21B:
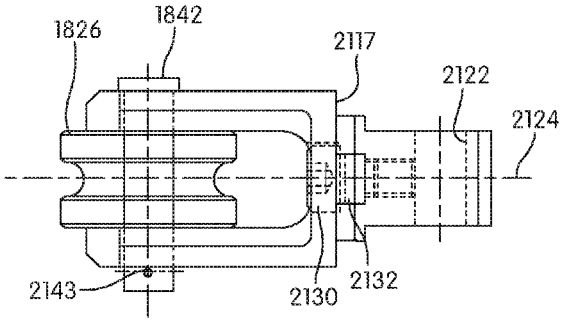
FIG. 21B is an alternate side view of the second coupler yoke assembly.
Figure 21C:
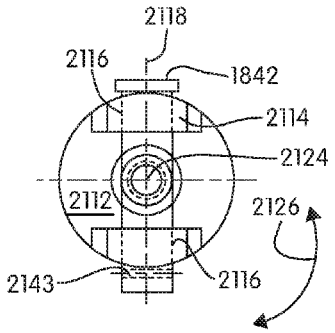
FIG. 21C is a top view of the second coupler yoke assembly.

Referring now to FIGS. 21A-21C, the second coupler yoke assembly 1840 is illustrated in further detail. The second coupler yoke assembly 1840 comprises a yoke body 2110. The yoke body 2110 comprises a base 2112 and, in this example, two spaced apart extensions 2114 extending from a first side 2115. The spaced apart extensions 2114 each have openings 2116 that have a common axis 2118 therethrough.

The second coupler yoke assembly 1840 also comprises a swivel post 2120 extending from a second side 2117 of the base 2112. The swivel post 2120 also has an opening 2122 extending therethrough. The opening 2122 is used for receiving the pin or fastener 1842 illustrated in FIG. 18 for securing the second coupler yoke assembly 1840 to the first coupler yoke 1830 using the fastener 1842. A channel 1843 through the fastener is used to receive a retainer (not shown) to prevent the fastener from decoupling from the second coupler yoke assembly 1840.

The swivel post 2120 swivels about axis 2124 in the direction indicated by arrows 2126. The yoke body 2110 can rotate completely around 360° relative to the swivel post 2120. The swivel post 2120 moves relative to the second yoke body 2110 by using a carriage bolt 2130. The carriage bolt 2130 includes a threadless region 2132 so that the components can rotate relative to each other.

Figure 22:
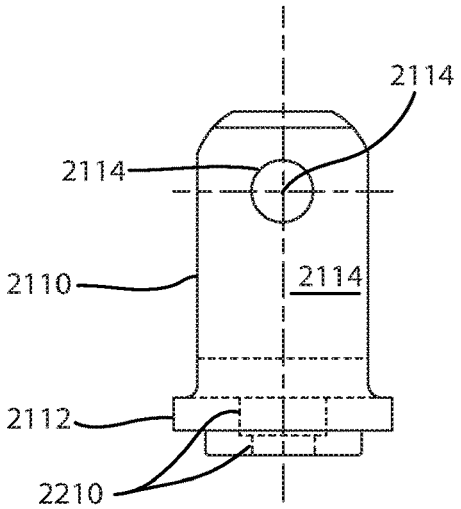
FIG. 22 is a side view of the second yoke extensions extending from a bottom portion.

Referring now to FIG. 22, the yoke body assembly 2110 is illustrated unassembled. The components are labelled the same as those set forth in FIGS. 21A-21C. The opening 2210 for the carriage bolt 2130 of FIG. 21 is illustrated more clearly.

Figure 23A:
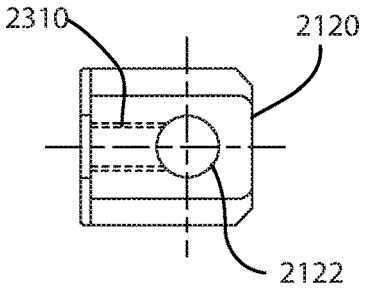
FIG. 23A is a side view of a swivel portion.
Figure 23B:
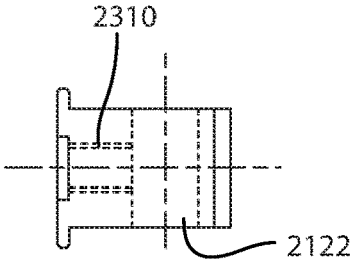
FIG. 23B is a front view of a swivel portion.
Figure 23C:
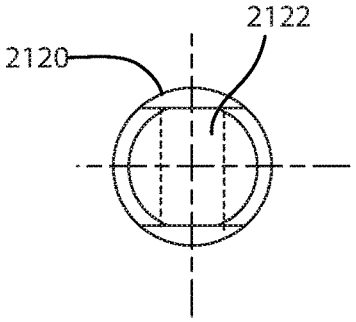
FIG. 23C is a bottom view of a swivel portion.

Referring now to FIGS. 23A, 23B and 23C, the swivel post 2120 is illustrated in further detail in an unassembled manner. In this example, threads 2310 are cut into the swivel post 2120 to receive the threaded carriage bolt 2140 illustrated in FIG. 21A.

Figure 24A:
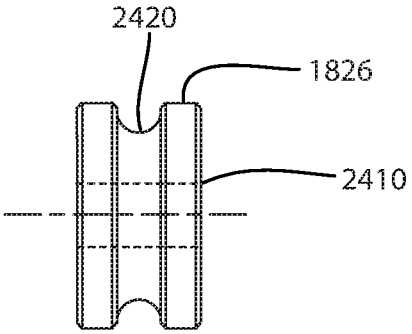
FIG. 24A is a side view of a pulley.
Figure 24B:
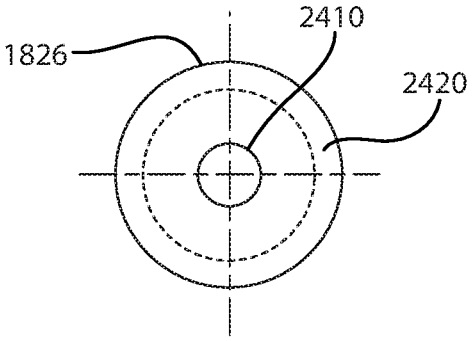
FIG. 24B is a front view of a pulley.

Referring now to FIG. 24A, a side view of the pulley 1826 is illustrated. The pulley 1826 comprises an opening 2410 for receiving the locating pin 1842 illustrated in FIGS. 18 and 21B. The pulley 1826 also includes a recessed channel 2420 around the circumference thereof. The recessed channel 2420 is used to receive and guide at least a portion of the chain used for performing various pulling functions.

Figure 25:
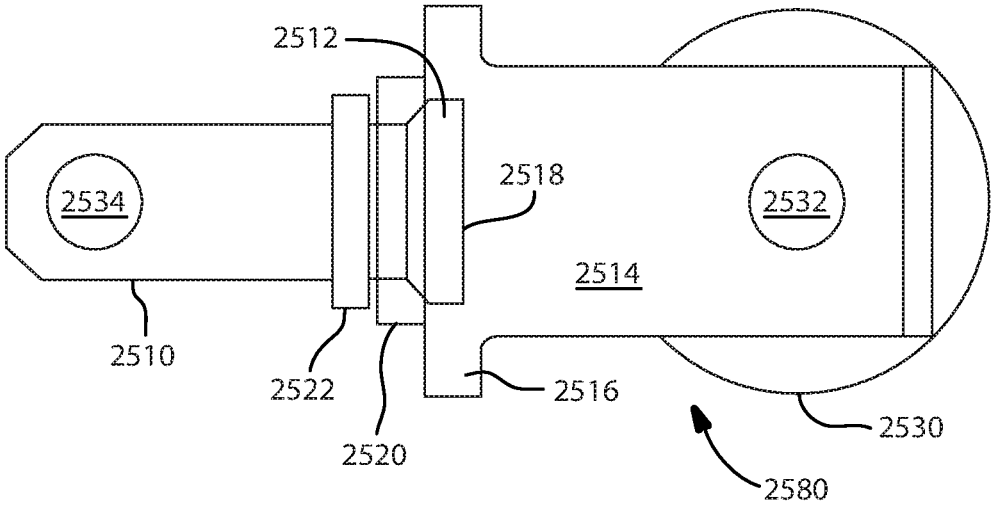
FIG. 25 is a side view of an alternate second coupler yoke assembly.

Referring now to FIG. 25, an alternate second coupler yoke assembly 2508 is illustrated. In this example, a swivel post 2510 has a flared portion 2512 extending therefrom. The second coupler yoke assembly 1835 has yoke extensions 2514 that extend from the bottom portion 2516. A recess 2518 is recessed into the bottom portion 2516 so that the flared portion 2512 may be received therein. A retainer 2520 may be used to retain the flared portion to the bottom portion. Threads, welding or other types of fasteners may be used to secure the retainer 2520 thereto. A second retainer 2522 may be used for added support. The extensions 2514 may also be used for securing a pulley 2530 to the extensions using a pin or other fastener 2532. An opening 2534 is used to receive a fastener or pin for securing the second coupler yoke assembly 2508 to the first coupler yoke.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A deck anchor assembly for a framed deck comprising:

a deck leverage anchor body engaging the framed deck; and a first coupler yoke coupled to the deck leverage anchor body; and a second coupler yoke assembly coupled to the first coupler yoke, said second coupler yoke assembly comprising a base portion having second yoke extensions extending therefrom and a swivel post extending from the base portion opposite the second yoke extensions, said swivel post rotatably mounted to the first coupler yoke using a fastener.

2. The deck anchor assembly of claim 1, wherein the base portion is rotatably mounted to the swivel post.

3. The deck anchor assembly of claim 1, wherein the base portion is rotatably mounted to the swivel post using a pin.

4. The deck anchor assembly of claim 3, further comprising a mounting bolt that couples the base portion to swivel extension.

5. The deck anchor assembly of claim 1, further comprising a pulley mounted to the second yoke extensions.

6. The deck anchor assembly of claim 1, further comprising a pulley mounted between the second yoke extensions with a pin extending through openings in the second yoke extensions.

7. The deck anchor assembly of claim 6, wherein the pulley comprises a center groove.

8. The deck anchor assembly of claim 6, wherein the pulley is disposed in front of the deck leverage anchor body relative to a direction of pulling force.

9. The deck anchor assembly of claim 1, wherein the first coupler yoke is rotatably coupled to the leverage anchor body.

10. The deck anchor assembly of claim 9, wherein the first coupler yoke is rotatably coupled to the deck leverage anchor body using a collar coupled to a groove in a swivel post.

11. The deck anchor assembly of claim 9, wherein the swivel post is rotatably coupled to first coupler yoke extensions.

12. The deck anchor assembly of claim 9, wherein the swivel post is rotatably coupled between two first coupler yoke extensions using a pin.

13. The deck anchor assembly of claim 1, wherein the fastener comprises a pin.

14. A frame rack comprising a tower, said frame rack comprising:

a deck leverage anchor as recited in claim 1; and a chain between the tower and the second coupler yoke assembly.

15. The frame rack of claim 14, wherein the chain is received in a circumferential recess within the second coupler yoke assembly.

* * * * *